United States Patent [19]

Dixon et al.

[11] 4,036,314

[45] July 19, 1977

[54] HOLE OPENER WITH IMPROVED ROTARY CUTTER MOUNTING

[75] Inventors: Robert L. Dixon, Brea; Robert E. Allison, Whittier, both of Calif.

[73] Assignee: Smith International, Inc., Irvine, Calif.

[21] Appl. No.: 700,313

[22] Filed: June 28, 1976

[51] Int. Cl.[2] ..... E21B 9/08

[52] U.S. Cl. ..... 175/364; 175/334; 175/340

[58] Field of Search ..... 175/363, 364, 346, 334, 175/347, 344, 342, 335, 356, 357, 358, 360, 361, 362, 374; 299/86; 308/8.2, 15

[56] References Cited

U.S. PATENT DOCUMENTS

| | | | |
|---|---|---|---|
| 874,603 | 12/1907 | Lee et al. | 175/360 X |
| 1,641,261 | 9/1927 | Fletcher | 175/371 |
| 1,945,964 | 2/1934 | Behnke | 175/364 X |
| 2,103,583 | 12/1937 | Howard et al. | 175/344 |
| 2,695,771 | 11/1954 | Salvatori et al. | 175/346 |
| 3,638,740 | 2/1972 | Justman | 175/344 X |
| 3,705,635 | 12/1972 | Conn | 175/364 |
| 3,750,772 | 8/1973 | Venter | 175/374 X |
| 3,863,994 | 2/1975 | Fink | 175/364 X |

*Primary Examiner*—Ernest R. Purser
*Assistant Examiner*—Richard E. Favreau
*Attorney, Agent, or Firm*—Christie, Parker & Hale

[57] ABSTRACT

This earth boring drill apparatus has a cutter mounting leg extending from one side of a drive stem and a removable cutter assembly, including a fixed shaft and cutter journaled for rotation on the shaft supported between the drive stem and the mounting leg. The stem has a bore for slidably receiving the inner end of the shaft. The cutter mounting leg terminates in an end surface extending parallel to the axis of rotation of the bore and shaft. A shaft supporting lug projecting from the outer end of the shaft has a surface which is parallel to the end surface on the leg. The opposed surfaces respectively have a V-shaped projection and mating groove which provide lateral alignment and prevent shaft rotation while permitting the shaft to be movable in an axial direction by an amount sufficient to permit the shaft to be withdrawn from the bore. Bolts extending between the mounting leg and the shaft at an angle clamp the mating surfaces of the groove and projection together and also clamp a pair of flat spacers between the mounting leg and the outer end of the shaft to lock the shaft in the bore.

12 Claims, 3 Drawing Figures

HOLE OPENER WITH IMPROVED ROTARY CUTTER MOUNTING

BACKGROUND OF THE INVENTION

This invention relates to rotary well drilling tools, and more particularly, to a hole opener or reamer with replaceable cutters. This application is related to U.S. Pat. application Ser. No. 593,036, entitled "Mounting for Inboard Cutters on a Raise Drill," filed July 3, 1975, by Robert L. Dixon and Malcolm D. Maxsted, and assigned to the same assignee as this application.

In earth boring reamers or hole openers, a series of rock boring cutters are rotatably mounted on a drive stem in such a manner that the outer edges of the cutters extend radially beyond the supporting structure so that the cutters enlarge or ream a hole of sufficient diameter to leave clearance for the upper portion of the hole opener. The rock boring cutter assemblies are preferably replaceable since these elements wear out and the drive stem can be reused.

These replaceable cutter assemblies conventionally have a fixed shaft on which a rock boring cutter is mounted for rotation. A variety of techniques have been used for mounting the shaft of the cutter assembly on the drive stem of the hole opener. In some embodiments the ends of the shaft are bolted or clamped in place. The principal technique utilizes a main pin which runs lengthwise of the mounting shaft on which the cutter is journaled for securing the shaft to the drive stem. Typically a diagonal bore and counterbore in the drive stem receive an end of the main pin and the shaft respectively. Retainer pins are used for securing the main pin and preventing its rotational and axial movement. Retainer pins permit minor movement of the pin and shaft with consequent fretting and wear.

The outer end of the shaft is supported by a mounting leg integral with, welded to, or otherwise secured to the drive stem. The outer end of this leg cannot extend beyond the outer edge of the conical rock boring cutter since clearance must be provided between it and the wall of the hole being reamed. Thus, the supporting leg is quite thin in the region of the bore for the outer end of the main pin. Since this results in small bearing surfaces, the bore in the leg is subject to excessive wear. Cracking and breakage through the main pin hole can result in premature failure of the drive stem. Flats or other means are provided on the leg for preventing rotation of the shaft. These regions eventually become deformed as the hole opener is used since they do not always mate tightly.

In the aforementioned co-pending application there is described a raise drill in which a cutter assembly is mounted by inserting the cutter journal shafts in a generally U-shaped opening between the mounting member and the drive stem. The inner end of the shaft is slidably fitted into a bore in the drive stem and the cutter assembly is locked in place by bolts and an inserted shim or spacer. The cutter mounting arrangement for a hole opener or reamer has close spacing requirements not present in the cutter mounting arrangement for a raise drill. It is therefore desirable to provide an easily mounted replaceable cutter assembly for a hole opener which does not subject the drive stem and mounting leg of the hole opener to excessive wear.

BRIEF SUMMARY OF THE INVENTION

This invention concerns an improved cutter assembly mounting arrangement for a hole opener or reamer in which the removable cutter assembly is rigidly affixed to the hole opener. A cutter mounting leg is secured to the drive stem of the hole opener. A removable cutter assembly having a fixed shaft and a rock boring cutter mounted thereon for rotation is fitted in a generally U-shaped opening between the mounting leg and the drive stem. The drive stem has a diagonal bore for slidably receiving the inner end of the shaft. The outer end of the shaft has a supporting lug tightly engaging the end of the mounting leg. The lug mounting leg have mating surfaces which extend parallel to the axis of the shaft for maintaining axial alignment with the bore and preventing rotation of the shaft.

The outer end of the shaft and the inner face of the mounting leg have parallel surfaces extending perpendicular to the axis of the shaft. These surfaces are spaced sufficiently to allow axial movement of the shaft into and out of the bore in the drive stem. After the cutter assembly has been inserted flat spacer means are inserted between the parallel surfaces and the assembly is clamped by bolts extending diagonally through the mounting leg, the spacer means and into the outer end of the shaft. The bolts hold the lug tightly against the end of the leg and also hold the parallel surfaces tightly against the spacer means to minimize fretting.

DRAWINGS

These and other features and advantages of the present invention will be appreciated as the same becomes better understood by reference to the following detailed description when considered in connection with the accompanying drawings wherein.

DESCRIPTION

Figure 1:
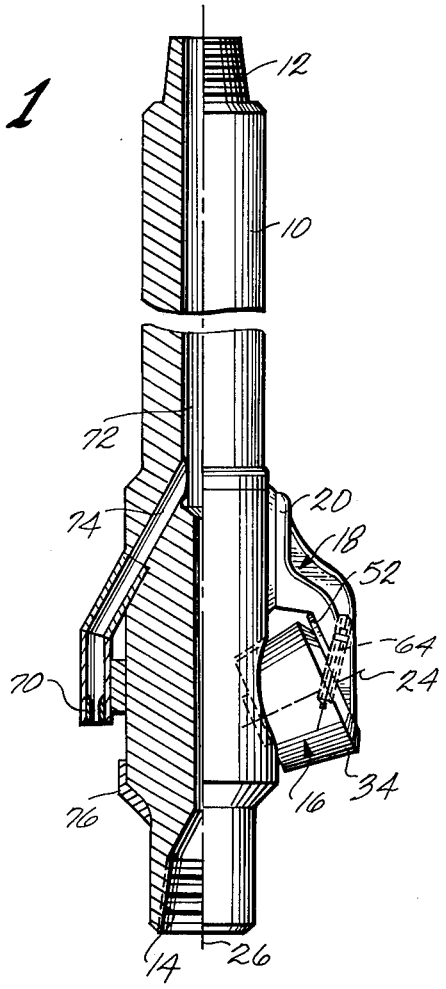
FIG. 1 is a side view partly in cross section of a hole opener constructed according to principles of this invention.
Figure 2:
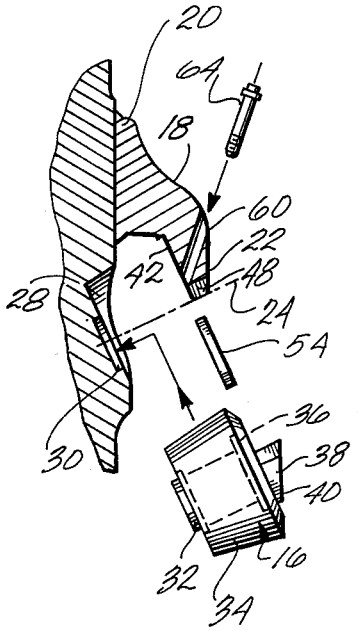
FIG. 2 is a fragmentary exploded view of a portion of the means for mounting the cutter assembly on the hole opener.
Figure 3:
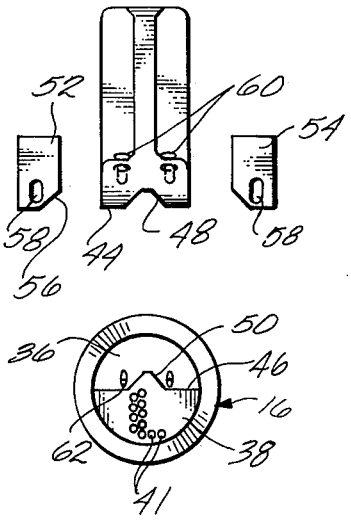
FIG. 3 is another fragmentary exploded view of a portion of the means for mounting the cutter assembly.

A presently preferred embodiment of hole opener constructed according to principles of this invention has a drive stem 10 with a threaded pin 12 at its upper end for connection to a drill string. The lower end of the drive stem includes a threaded box 14 for attachment to a rock boring drill bit which can be used, for example, to drill an initial pilot hole. A bull nose pilot can also be attached to the box 14. Such connections and usages are conventional.

The hole opener typically is provided with three similar rock boring cutter assemblies spaced circumferentially about the axis of rotation of the drive stem 10. For clarity only one such cutter assembly is shown as indicated generally with reference numeral 16. Each cutter assembly 16 is supported at its outer end by a mounting member or leg indicated generally by reference numeral 18. The cutter mounting leg includes a base portion 20 which is secured to the drive stem above the cutter assembly, preferably by welding directly to the drive stem to form a rigid integral structure. The mounting leg terminates at its outer end in a cutter mounting portion 22 spaced apart from the drive stem to form a generally U-shaped opening or yoke for receiving the cutter assembly 16.

Before the cutter mounting leg 18 is welded to the drive stem 10, the drive stem is bored and counterbored along an axis 24 which intersects the axis of rotation 26 of the drive stem at an included acute angle of substantially less than 90°, such as for example, an angle of about 65°. Thus the drive shaft has relatively larger diameter counterbore 28 and smaller diameter bore 30.

The cutter assembly 16 includes a fixed shaft 32 on which is journaled a conventional conical shaped rock boring rotary cutter 34. As illustrated in the drawings the cutter 34 appears to have a smoother external conical surface which has been shown solely for purposes of clarity. It will be understood, of course, that the external surfaces of the rock boring cutter have teeth or tungsten carbide inserts as are conventional for rock boring cutters. Similarly details of the bearings for mounting the cutter on the shaft have been omitted since conventional and not needed for an understanding of this invention.

The inner end of the cutter mounting shaft 32 projects beyond the inner face of the cutter 34 a distance slightly shorter than the depth of the inner bore 30. This projecting end is cylindrical and has a sliding fit into the bore 30. The outer end of the shaft 32 has a retainer flange 36 which is recessed in the outer end of the cutter 34. Integral with the outer flange end of the shaft 32 is a supporting lug or "shirt tail" which projects beyond the outer end of the cutter. The outer end of the lug 38 is bevelled and somewhat rounded to form an outer surface 40 which, when the cutter assembly is in position on the hole opener as shown in FIG. 1, extends parallel to the axis of rotation 26 of the hole opener. Preferably a number of tungsten carbide inserts 41 are provided on the outer face 40 of the shirt tail for wear resistance and to help assure that the hole is reamed to full gauge, thereby helping minimize wear on the cutter mounting leg.

If desired the outer part of the cutter mounting leg can be covered with conventional welded hard facing alloy for resisting wear.

The cutter mounting leg has an inner flat surface 42 perpendicular to the axis of the shaft 32 of the cutter assembly and the axis of the bore 30. The inner flat surface 42 on the leg is spaced sufficiently from the bottom of the counterbore 28 in the drive stem that the supporting shaft of the cutter assembly 16 can fit into the U-shaped yoke formed by the mounting leg 18 and drive stem 10. The cutter asembly can then be axially shifted inwardly to insert the cylindrical end of the cutter mounting shaft 32 into the inner bore 30.

The outer end of the mounting leg 18 has a flat surface 44 which preferably lies in the same plane as the axis of rotation 24 of the cutter. The flat surface should at least be parallel to the axis of rotation 24 and can be displaced therefrom. The lug 38 on the outer end of the shaft has a pair of flat surfaces 46 parallel to the flat surface 44 on the leg and having a small clearance therefrom when assembled. Axial alignment of the cutter assembly 16 is assured by a V-shaped groove 48 in the flat surface 44 on the end of the cutter mounting leg. A mating V-shaped projection 50 on the flat surface 46 of the lug 38 engages the groove 48 to assure precise centering of the shaft on the axis of the bore. The groove and projection also prevent rotation of the shaft during use. The V-shaped groove 48 and projection 50 are both parallel to the axis of rotation of the cutter and thereby permit axial movement of the cutter assembly into or out of the mounted position.

Once the inner end of the cutter mounting shaft 32 is seated in the inner bore 30, the cutter assembly 16 is positioned by inserting a pair of flat spacer plates 52 and 54 between the inner surface 42 of the mounting leg 18 and the outer surface of the flange portion 36 of the shaft 32.

The spacers are generally rectangular in shape with one mitered corner 56 for clearance for the projection 50 on the end of the cutter shaft. The spacers act as shims and are slightly thicker than the length of the projection on the inner end of the shaft. The spacer plates 52 and 54 are inserted from opposite sides of the mounting leg after the cutter assembly has been inserted. The spacer plates between the outer end of the shaft and the inner face of the cutter mounting leg prevent withdrawal of the cutter assembly from the bore 30.

The spacer plates 52 and 54 have openings in the form of elongated slots 58 (or diagonal holes) which align with diagonal holes 60 extending through the mounting end portion 22 of the mounting leg 18. The axes of the holes 60 are aligned with the axes of threaded holes 62 in the outer end of the shaft 32 when the spacer plates are in position. Bolts 64 are inserted through the holes 60, the slotted opening 58 in the spacer plates and into the threaded holes 62 in the shaft 32. When tightened the bolts 64 cause the spacer plates to be securely clamped in position between the shaft and mounting legs and the lug 38 to be securely clamped against the mounting portion 22 of the mounting leg 18. The diagonal alignment of the bolts 64 at an angle to both the inner face of the mounting legs and the sides of the V-shaped groove at the end of the leg produces components of force normal to the mating surfaces 48 and 50 and also normal to the inner face 42 on the mounting legs for clamping the spacer plates 52 and 54 and the shaft 38 securely in place. Tightening the bolts pulls the shaft outwardly and prevents the cutter from rubbing on the drive stem. Manufacturing tolerances also cause the shaft to be cocked slightly in the bore on the drive stem. This "binding" minimizes fretting at the inner end of the shaft. It will be noted that although a pair of bolts are used in this embodiment, a single bolt at an angle to both the inner surface 42 on the leg and the V-shaped groove 48 will lock the cutter assembly tightly.

From the above description it will be seen that a mounting arrangement is provided for a rock boring cutter assembly on a hole opener which permits the cutter assembly to be replaceable. The mounting arrangement anchors the cutter assembly tightly against radial as well as axial movement using a pair of bolts without any alignment or retainer pins. The results is a much stronger, firmer mounting arrangement than has heretofore been achieved. The cutter assembly is sufficiently rigid to resist severe loading on the cutter without wear on the mating surfaces of the mounting leg and yet the cutter assembly can be easily removed for repair or replacement. None of the alignment surfaces on the mounting leg have rotation or other movement that can lead to fretting or other wear, thereby minimizing requirements for replacement or repair of such mounting legs.

In addition to the three cutter assemblies mounted on the drive stem, three replaceable tungsten carbide drilling fluid nozzles 70 are also mounted on the drive stem. These nozzles are spaced at circumferential locations between the three cutter assemblies. Each of the nozzles is connected to an axial passage 72 through the drive stem 10 by a diagonal passage 74. The nozzles provide a flow of drilling fluid for jet blasting of the ledge where the cutters 34 are reaming, rock chip removal into the normal circulation stream of drilling fluid and the like.

A pad 76 of welded hard facing material or the like is formed on the lower part of the drive stem to help assure alignment with a pilot hole and eliminate drive stem wear. The pad can also help ream an undersize pilot hole. Such a wear pad can be readily restored in the field as required.

Although but one embodiment of hole opener or well reamer constructed according to principles of this invention has been described and illustrated herein many modifications and variations will be apparent to one skilled in the art. It is therefore to be understood that within the scope of the appended claims the invention may be practiced otherwise than as specifically described.

What is claimed is:

1. An earth boring drill apparatus comprising a drive stem, a cutter mounting leg secured to the stem, a removable cutter assembly including a shaft and a rock boring cutter mounted for rotation on the shaft, a bore in a side of the stem for slidably receiving the inner end of the shaft; the cutter mounting leg having a shaft supporting portion spaced apart from and extending substantially parallel to the stem for supporting the outer end of the cutter shaft; a support engaging lug on the outer end of the cutter shaft, the shaft supporting portion of the mounting leg and the support engaging lug having mating surfaces extending parallel to the axis of the shaft for maintaining axial alignment of the shaft and the bore and preventing rotation of the shaft, the shaft being movable in an axial direction between the stem and the mounting leg with the mating surfaces in contact by an amount sufficient to permit the shaft to be withdrawn from the bore, and means clamping the opposing surfaces together to secure the outer end of the cutter assembly to the mounting leg.

2. The apparatus of claim 1 wherein the mating surfaces comprise a projection on the lug and a mating groove on the cutter mounting leg, said projection and groove each having a V-shaped cross section.

3. The apparatus of claim 1 further comprising flat spacer means perpendicular to the axis of the shaft between the outer end of the cutter mounting leg.

4. The apparatus of claim 1 wherein the shaft supporting portion of the cutter mounting leg has an outer surface extending substantially parallel to the axis of the stem and an inner surface extending substantially perpendicular to the axis of the bore and shaft.

5. The apparatus of claim 4 wherein the outer surface on the leg comprises a V-shaped groove and the mating surface on the lug comprises a V-shaped projection.

6. The apparatus of claim 1 wherein the outer end of the cutter shaft has a stop surface extending substantially perpendicular to the shaft, and cutter mounting leg has an inner surface parallel to the stop surface.

7. The apparatus of claim 6 further comprising spacer means between said stop surface and said inner surface, and wherein said clamping means provides a force on the shaft in an outward direction to clamp the spacer means between said surfaces.

8. The apparatus of claim 7 wherein the clamping means comprises one or more bolts extending through the shaft supporting portion of the cutter mounting leg, the spacer means, and threadedly engaging the shaft, the bolts extending at an acute angle to both the mating surfaces and the inner surface of the shaft supporting portion of the cutter mounting leg.

9. A hole opener having a drive stem including means for connecting the stem to a drill string at its upper end comprising:

a bore in the drive stem at an acute angle to the axis of the drive stem;

a mounting leg secured to the drive stem and having a portion extending downwardly to define a generally U-shaped opening between the mounting leg and the drive stem, the inner face of the mounting leg being opposite the bore and normal to the axis thereof;

a rock boring cutter assembly mounted in the U-shaped opening including a fixed shaft having an inner end slidably fitted into the bore and a cutter mounted for rotation on the shaft;

a lug on the outer end of the shaft having a shirt tail portion mated with the lower end of the mounting leg for supporting the shaft in the direction of the axis of the drive stem and preventing rotation of the shaft;

a pair of flat spacers removably fitted between the outer end of the shaft and the inner face of the mounting leg, said spacers being insertable or removable from opposite sides of the mounting leg when the cutter assembly is mounted in the U-shaped opening; and bolt means for securing the outer end of the shaft to the mounting leg with the spacers therebetween.

10. A hole opener as recited in claim 9 wherein the lower end of the mounting leg and the lug each have mating surfaces parallel to the axis of the cutter mounting shaft for guiding axial movement of the inner end of the shaft into and out of the bore.

11. A hole opener as recited in claim 10 wherein the mating surfaces comprise a groove on the cutter mounting leg and a projection on the lug, and wherein said projection and groove have a generally V-shaped cross section.

12. A hole opener as recited in claim 10 wherein the bolt means extends at an acute angle to both the inner face of the mounting leg and the mating surfaces.

* * * * *

UNITED STATES PATENT AND TRADEMARK OFFICE

CERTIFICATE OF CORRECTION

PATENT NO. : 4,036,314

DATED : July 19, 1977

INVENTOR(S) : Robert L. Dixon, Robert E. Allison

It is certified that error appears in the above-identified patent and that said Letters Patent are hereby corrected as shown below:

Column 1, line 23, "replaceaable" should be -- replaceable --.

Column 2, line 14, -- and -- should be inserted between "lug" and "mounting".

Column 3, line 8, -- a -- should be inserted between "has" and "relatively".

Column 3, line 29, -- 38 -- should be inserted after "shirt tail" and before "which".

Column 4, line 54, "results" should be -- result --.

Column 5, line 50, -- shaft and the -- should be inserted after "the" and before "cutter".

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*